United States Patent [19]

Zanasi

[11] 4,089,152

[45] May 16, 1978

[54] CAPSULE FILLING MACHINE

[76] Inventor: Luciano Zanasi, 7/5 Via Monaldo Calari, Bologna, Italy

[21] Appl. No.: 774,347

[22] Filed: Mar. 4, 1977

[30] Foreign Application Priority Data

Mar. 5, 1976 Italy ..... 12516 A/76

[51] Int. Cl.[2] ..... B65B 1/04; B65B 43/40

[52] U.S. Cl. ..... 53/281

[58] Field of Search ..... 53/281; 408/76

[56] References Cited

U.S. PATENT DOCUMENTS

| | | | |
|---|---|---|---|
| 3,049,031 | 8/1962 | Carstens | 408/76 |
| 3,070,932 | 1/1963 | Höfliger | 53/281 |
| 3,256,043 | 6/1966 | Krekeler | 408/76 X |

*Primary Examiner*—Travis S. McGehee

*Attorney, Agent, or Firm*—Pollock, Vande Sande & Priddy

[57] ABSTRACT

The capsule filling machine comprises a plurality of capsule handling devices, such as capsule upright setting devices, capsule holders, capsule openers and capsule closers, which are removably secured onto fixed or movable parts of the machine by means of a magnetic connection. A permanent magnet is provided on the fixed or movable part of the machine, and each handling device presents, in correspondence of the part which is intended to come into contact with the permanent magnet, a portion made of ferromagnetic material.

3 Claims, 5 Drawing Figures

CAPSULE FILLING MACHINE

BACKGROUND AND SUMMARY OF THE INVENTION

The present invention relates to a machine for filling capsules, particularly for filling rigid two-part gelatine capsules with pharmaceutical substances, said machine being of the type comprising a plurality of capsule handling devices, such as for example capsule upright setting devices, capsule holders, capsule openers and capsule closers, which are secured in a removable manner onto fixed parts or movable parts, such as rotary conveyors, of the machine itself.

In this type of machine it is frequently required to remove the said capsule handling devices either for cleaning purposes or for substituting same, particularly in the case of variation of the diameter of the capsules which are subject to the filling operation. In the known machines the capsule handling devices are secured to the fixed or movable parts of the machines by means of mechanical fasteners, such as screws, locking rings and the like. Therefore, the operation of removal of all the capsule handling devices and their re-setting again, or their substitution with other capsule handling devices, takes up a lot of time and requires skilled labor. Moreover, modern capsule filling machines are of compact construction, in order to save space and material and to allow greater operating speeds. Thus the capsule handling devices are very closely arranged next to one another, and therefore the need is felt for means for removably securing the said capsule handling devices in the most simple and space-saving manner.

According to the invention, the capsule handling devices, such as capsule upright setting devices, capsule holders, capsule openers, capsule closers, are secured in an easily removable manner on the machine by means of a magnetic connection. Preferably, a permanent magnet is provided on the fixed or movable machine parts, while a ferromagnetic pastille or disc is provided on the capsule handling device. The correct positioning of the capsule handling devices on the fixed or movable parts of the machine onto which they are removably secured is ensured by suitable centering means, such as centering pins and bores provided on the contacting parts, or by shaping the said contacting parts in a complementary manner. Since the capsule handling devices are not subjected to great stresses or impact forces, the connection due to the magnetic attraction will be sufficient for maintaining the said devices in their correct position of operation.

These and other features of the invention and the advantages deriving therefrom will be clearly understood from the following description of a preferred embodiment thereof, with reference to the accompanying drawings.

DESCRIPTION OF THE PREFERRED EMBODIMENT

Figure 2:
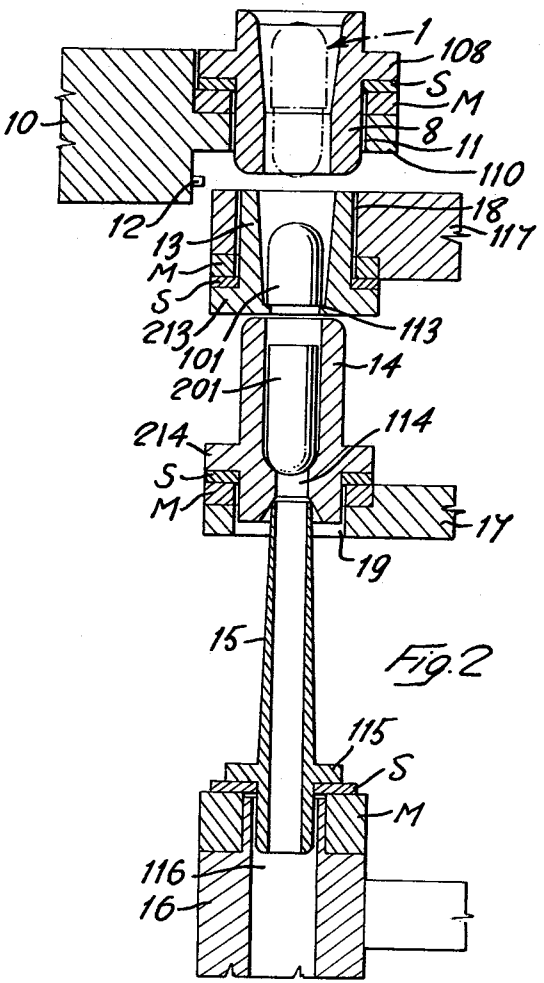
FIG. 2 is a vertical section of a detail showing a capsule opener device.

In the drawings there are illustrated, without any intention of limitation, the capsule holders or capsule handling devices which are usually provided in some stations of an automatic capsule filling machine. The automatic capsule filling machine is adapted for the filling of rigid two-part gelatine capsules 1, which consist each of an upper lid portion 101 and of a lower base portion 201 inserted therein, said capsules being filled with a measured amount of a pharmaceutical substance, for example in powder form.

Figure 1:
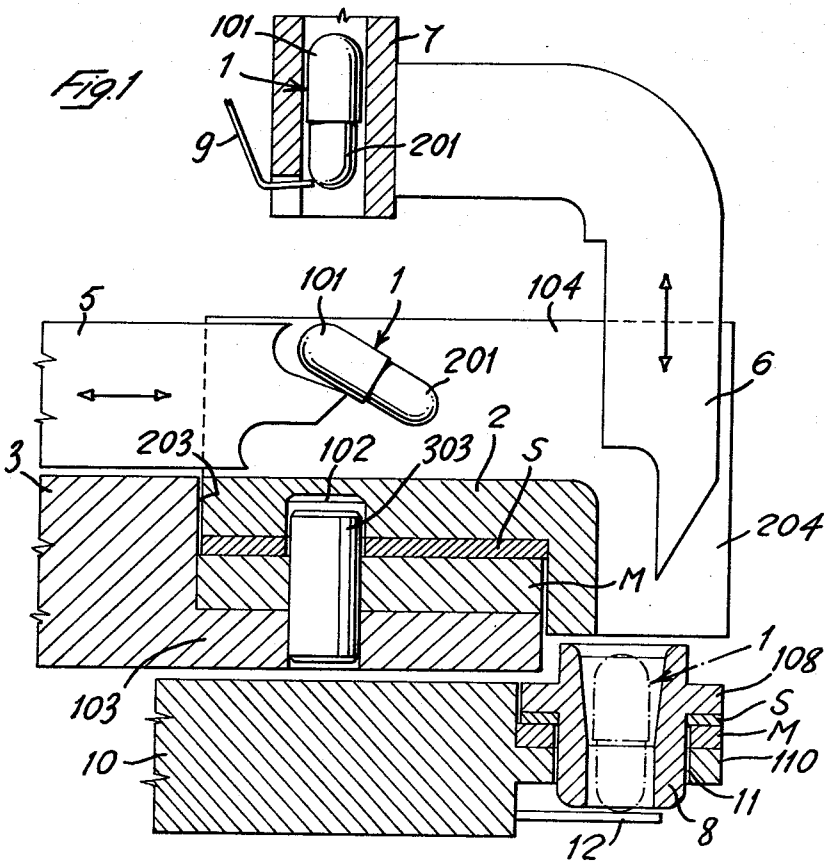
FIG. 1 is a vertical section of a detail showing a capsule upright setting device, and a capsule holder.

Referring particularly to FIG. 1, there is illustrated the device for feeding and orderly arranging the capsules 1. The said device comprises an element 2, for setting the capsules upright, which is secured to a fixed part 3 of the machine frame, or to a rotary conveyor of the machine itself. The element 2 presents a channel-like passage 104, 204 for the capsules 1. The said passage consists of a horizontal channel portion 104 and of a vertical channel portion 204. A pusher 5 operates in correspondence of the horizontal channel portion 104, while another pusher 6 operates in correspondence of the lower channel portion 204. The capsules 1 are fed from a feeding tube 7, the said feeding being controlled by a barrier pin 9, and fall down into the channel-like passage 104, 204, where they are positioned in a correct upright position, so as to be eventually fed into the holder device 8 presenting the longitudinal axis which is vertical, the lid portion upwardly and the base portion downwardly. The capsule upright setting element 2 is arranged in correspondence of a recess 103 of the machine frame 3 or rotary conveyor, and on its underside there is secured, for example by glueing, a disc S made of ferromagnetic material. On the upper side of the recess 103 there is secured (for example by glueing) a permanent magnet M. In this manner there is obtained a magnetic connection between the element 2 and the machine frame or rotary conveyor 3. The correct positioning of the element 2, without possibility of rotational or side movements, is obtained by the cooperation of the side of the said element with the vertical side wall 203 of the machine frame or conveyor 3, and by the insertion of a centering pin 303, provided on said frame or conveyor 3, into a dead hole 102 provided on the underside of element 2.

The capsule holder 8 is secured onto a rotary conveyor 10. The said capsule holder 8 is constructed as a socket element which is open both at the top and the bottom. Each holder 8 is inserted in a vertical bore 11 provided in an annular projecting portion 110 of the conveyor 10, and rests on said portion 110 with its enlarged annular portion 108. The connection between the holder 8 and the conveyor 10 is obtained through a ring-shaped permanent magnet M secured on the annular portion 110 and a ring-shaped ferromagnetic piece S secured on the underside of the enlarged portion 108 of holder 8.

The capsule 1 fed into the holder 8 is loosely inserted therein and supported by a supporting slide 12. The holder 8 is then positioned, as shown in FIG. 2, above a device for opening the capsule. This device is mounted on a lower rotary conveyor 17, 117 and comprises two vertical superimposed sockets 13 and 14. The upper socket 13 has a continuous bore which terminates in a narrow annular step 113. The said annular step 113 serves as a stop for the bottom edge of the lid portion 101 of the capsule 1, and holds and supports said lid portion, while it permits the passage of the base portion 201 which drops into the lower socket 14 which is provided at its bottom with a suction bore 114 into which there is temporarily inserted the suction pipe 15 which is on its turn secured on a suction head 16 vertically movable up and down.

It appears evident that the capsule 1 falls from the holder 8, as soon as the slide 12 is retracted, into the capsule opener device. More particularly, the lid portion 101 remains in the upper socket 13, while the base portion is sucked inside the lower socket 14. The upper socket 13 is secured to the rotary conveyor 117 through a magnetic connection consisting of a disc-shaped permanent magnet M on the underside of the rotary conveyor 117, and a ferromagnetic disc S provided on an annular flange portion 213 of the said socket 13. The lower socket 14 is secured to the rotary conveyor 17 through a magnetic connection consisting of a disc-shaped permanent magnet M on the said conveyor 17 and of a ferromagnetic disc S on the annular enlarged portion 214 of socket 14. Similarly, the connection between the suction pipe 15 and the suction head 16 is obtained by providing a disc-shaped permanent magnet M on the supporting head 16 and a ferromagnetic disc S on the underside of the annular flange portion 115 of said pipe 15.

Figure 3:
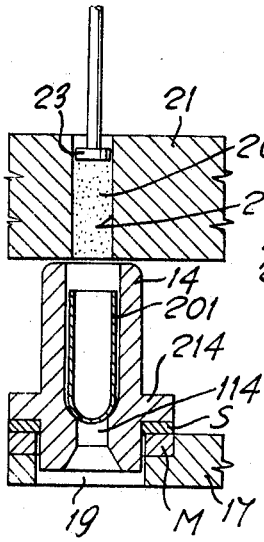
FIG. 3 is a vertical section of a detail showing a capsule filling device.

In FIG. 3 there is illustrated the filling station, where the base portion 201 of the capsule is filled with the powdered material 20 contained in the vertical bore 22 of the loading element 21. The material 20 is pushed down into the capsule by the piston 23.

Figure 4:
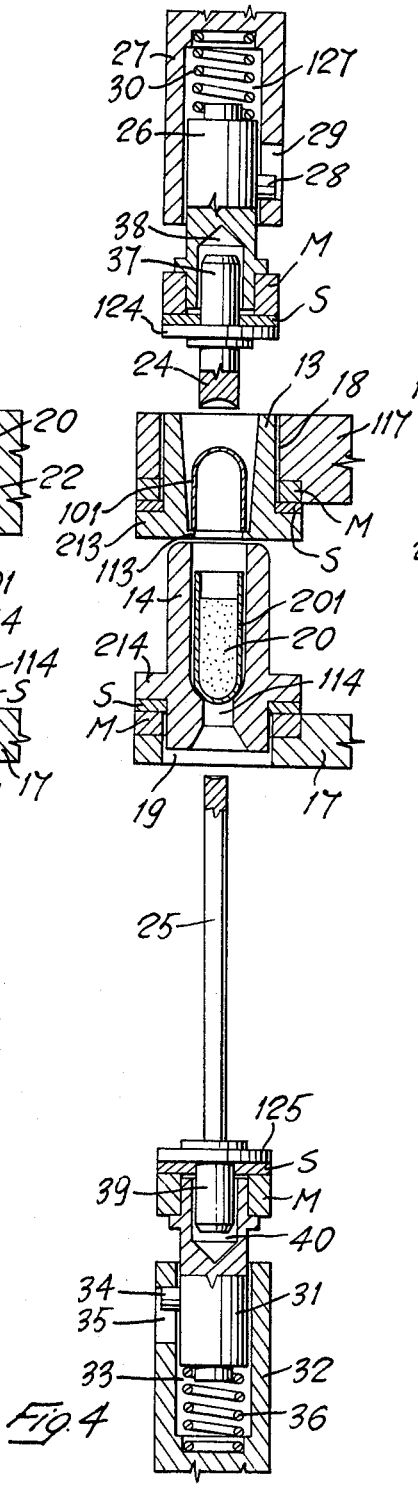
FIGS. 4 and 5 are vertical sections of a detail showing a capsule closer device, in two different operating positions.
Figure 5:
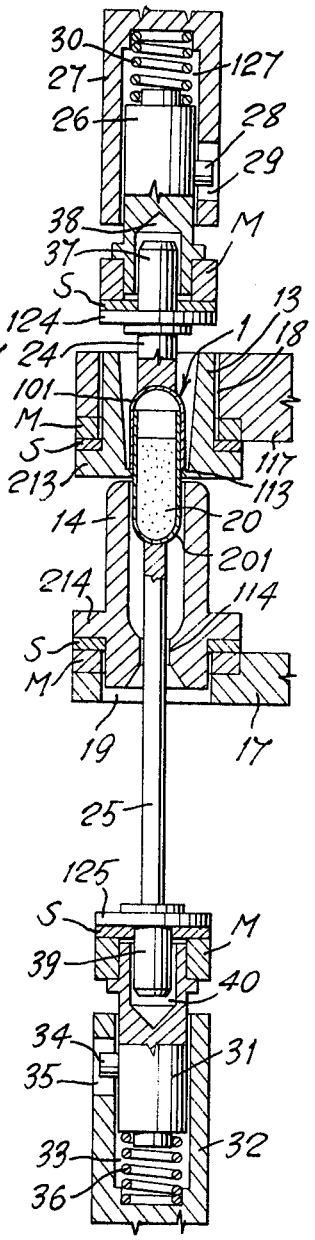

The base portion of the capsule thus filled is then closed, at the station illustrated in FIGS. 4 and 5. More particularly, the upper socket 13 and the lower socket 14 are again brought into vertical alignment, by movement of the respective conveyors 117 and 17, and a push rod 25 pushes the base portion 201 of the capsule upward so as to insert it again into the lid portion 101, which is kept at its place in the upper socket 13 by means of an abutment pin 24.

The abutment pin 24 is carried by a carrier element 26 which is slidable at the interior of a cylindrical cavity 127 of a vertically reciprocating element 27. The carrier element 26 is urged downwardly by spring 30, and its movement at the interior of cavity 127 is limited by the side pin 28 engaging the slot 29. The actual connection between the abutment pin 24 and the carrier element 26 is obtained by means of a ring-shaped permanent magnet M on the lower end of said carrier element 26, and a ferromagnetic disc S on the upper side of the enlarged head portion 124 of pin 24. The centering of the two components of the magnetic connection is assured by the centering pin 37 (coaxial to pin 24) which enters inside the bore 38 centrally provided in the carrier element 26.

In a similar manner, the push rod 25 is carried by a carrier element 31 which is mounted slidably at the interior of a cylindrical cavity 33 of a vertically reciprocating element 32. The carrier element 31 is urged upwardly by a spring 36, and its movement at the interior of the cavity is limited by the side pin 34 engaging the slot 35. The actual connection between the push rod 25 and its carrier element 31 is obtained by means of a ring-shaped permanent magnet M provided on the upper end of said carrier element 31, and a ferromagnetic disc S on the underside of the enlarged end portion 125 of rod 25. The centering of the two components of the magnetic connection is assured by the centering pin 39 (co-axial to rod 25) which enters inside the bore 40 centrally provided in the carrier element 31.

From the above description it appears evident that the removable parts, i.e., the parts which can be replaced with analogous parts on the body of the machine or on the rotary conveyors, such as the element 2 for setting the capsules upright, the holder 8, the sockets 13 and 14, the suction pipe 15, the push rod 25 and the abutment pin 24, may be made wholly or partially of any suitable non-magnetic material, such as light metals or plastics. It is in fact sufficient that these removable parts be provided with the ferromagnetic element S, in the form of a disc, pastille or any other suitable form. This characteristic feature is very important, since it enables the use of low cost materials.

I claim:

1. A machine for handling capsules comprising means for aligning, holding, opening, filling and closing capsules, including (a) means for aligning said capsules in an upright position;
(b) a release mechanism operable to permit a said capsule to drop into a substantially L-shaped, channel-like passage;
(c) means within said passage for moving said capsule through said passage;
(d) a socket-shaped means at the end of said passage for receiving and holding said capsule;
(e) a first rotary conveyor;
(f) a device for opening said capsule;
(g) a second rotary conveyor on which said opening device is mounted and which is located below said first rotary conveyor;
(h) a second release mechanism operable to permit a said capsule to drop from said socket-shaped means into said opening device;
(i) means for filling said capsule;
(j) means for closing said capsule;
(k) permanent magnets provided on portions of said machine; and
(l) portions of ferromagnetic material on said capsule handling means interacting with respective said permanent magnets, whereby said capsule handling means are centered with respect to the corresponding portions of said machine.

2. A machine according to claim 1, wherein said capsule handling devices are made of ferromagnetic material.

3. A machine according to claim 1, wherein said capsule handling devices are made of non-magnetic materials, such as light metals and plastics, and are provided with a suitably shaped ferromagnetic pastille.

* * * * *